United States Patent [19]

Smoot et al.

[11] 4,438,433

[45] Mar. 20, 1984

[54] MULTIADDRESS PAGER WITH A CALL STORAGE AND PRIORITY PAGING OPTION

[75] Inventors: George W. Smoot, Sunrise; Philip P. Macnak, Plantation, both of Fla.

[73] Assignee: Motorola, Inc., Schaumburg, Ill.

[21] Appl. No.: 306,799

[22] Filed: Sep. 29, 1981

[51] Int. Cl.[3] ..... G08B 5/22

[52] U.S. Cl. ..... 340/825.44; 340/825.5; 455/31

[58] Field of Search ..... 340/825.44, 825.48, 340/825.46, 825.47, 825.5, 825.51; 455/31, 38, 32

[56] References Cited

U.S. PATENT DOCUMENTS

| | | | |
|---|---|---|---|
| 3,742,481 | 6/1973 | Nickerson | 340/825.44 |
| 3,823,375 | 7/1974 | Wycoff | 340/825.5 |
| 4,010,460 | 3/1977 | De Rosa | 340/825.44 |
| 4,019,142 | 4/1977 | Wycoff | 455/38 |
| 4,145,684 | 3/1979 | Stodoloski | 340/825.44 |
| 4,160,240 | 7/1979 | Partipilo | 455/38 |
| 4,197,526 | 4/1980 | Levine et al. | 340/825.44 |
| 4,336,524 | 6/1982 | Levine | 340/825.44 |

OTHER PUBLICATIONS

*IBM Technical Disclosure Bulletin,* Dellheim, vol. 20, No. 1, Jun. 1977, pp. 313–314.

*Primary Examiner*—James J. Groody

*Attorney, Agent, or Firm*—John H. Moore; James W. Gillman; Edward M. Roney

[57] ABSTRACT

A pager includes means for receiving emergency calls immediately upon reception of the emergency calls and means for receiving non-emergency calls and, storing the non-emergency calls for subsequent readout upon interrogation. The pager is shown implemented in hard-wired logic form and alternatively in a programmable microprocessor form.

17 Claims, 5 Drawing Figures

MULTIADDRESS PAGER WITH A CALL STORAGE AND PRIORITY PAGING OPTION

FIELD OF INVENTION

This invention relates to a pager in general and, in particular, an improved multiaddress pager provided with means for receiving and storing one or more non-emergency paging calls until they are read out by the user later and priority paging means for alerting the user immediately upon receipt of emergency calls.

BACKGROUND OF THE INVENTION

With many recent advances in paging systems, it is found that more and more sophisticated and versatile paging services are in demand. For example, some paging systems already provide pagers with circuit features that allow the user, or otherwise known as subscriber, to cause an incoming paging signal to be stored for read-out later at his convenience. This is especially found desirable where the paging signal is in the form of audible tones. This type of paging system and pager is used where the subscriber does not wish to let the pager generate an audible sound which may disturb him or others who are with him as the pager receives the incoming calls. The subscriber would rather have the pager store the incoming calls and provide audible tones later at his convenience. Occasions that require the foregoing type of paging are numerous, for example, doctors in an operating room or business and professional people in conferences, etc. Although the above illustrates the application of storing incoming paging calls which later will be read out in the form of audible tones, the alerting signal need not be limited to an audible signal, but could be visual or tactile as well.

For a specific and illustrative example of pagers that store the incoming paging calls for subsequent readout upon interrogation, one may refer to the U.S. Pat. No. 3,742,481, granted to Douglas W. Nickerson on June 26, 1973, and assigned to the present assignee.

With time, demand for more and different features or options are placed on paging systems and pagers. One demand now placed on pagers is that they not only provide the feature where calls can be stored for later read-out capability but also a priority feature which can bypass the call-store routine and instead immediately alert the subscriber. This need is best illustrated by way of an example. A physician subscriber, or doctor, may wish to have routine non-emergency calls from his office or hospital stored for later read-out, at his option. But there are certain types of emergency calls that he must receive immediately without any delay. Such a call should bypass or override the store-and-subsequent-readout-routine option.

SUMMARY OF THE INVENTION

It is the object of the present invention to provide an improved pager in general and, in particular, an improved pager that is capable of receiving emergency calls that must be answered immediately, as well as non-emergency calls that can be received but can be stored for later read-out at the convenience of the user of the pager.

The foregoing and other objects of the present invention are attained in accordance with the present invention by a pager that includes a decoder for receiving and decoding the incoming calls, a shift-register memory which stores data for decoding and priority options, wherein the decoder and shift-register memory are adapted to generate a priority status level signal when the incoming signal is an emergency call and a non-priority status level signal when the incoming signal is a non-emergency call, means responsive to the priority status level signal for generating an alert signal immediately upon detection thereof, means for storing the non-priority status signals for subsequent read-out, and means responsive to actuation by the operator for reading out the non-priority signals from the storing means.

It is a feature of the present invention that the pager includes means for distinguishing between emergency-type calling signals and non-emergency-type calling signals and means effecting immediate read-out of emergency-type signals.

It is yet another feature of the present invention that a pager is designed to use a microprocessor, memory means for decoding and priority options, and an instruction memory, a predetermined instruction sequence stored therein for operating the microprocessor to respond immediately to the emergency calls generate and alert signal and for storing non-emergency calls for later read-out.

It is a further feature of the present invention where an external decoder is used to receive incoming paging signals and applying the decoded received signals or results thereof to a microprocessor for processing the incoming calls in conjunction with the data memory and the instruction memory in a manner similar to that described above.

The present invention will be more clearly appreciated from the following detailed description of an illustrative embodiment of the present invention with reference to the accompanying drawings.

DETAILED DESCRIPTION OF THE INVENTION

Figure 1:
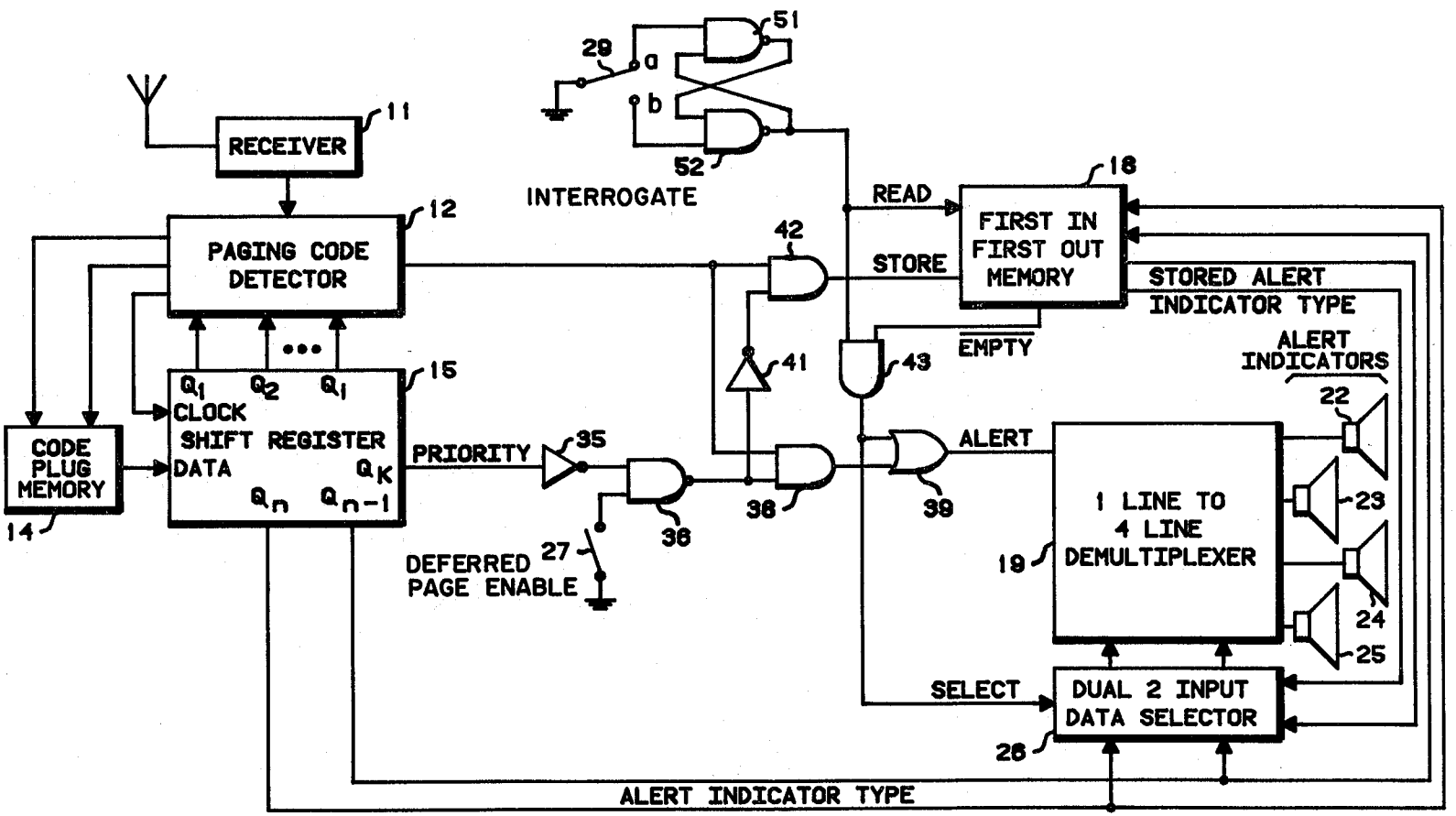
FIG. 1 shows a functional schematic drawing embodying the present inventive pager primarily in a hard-wired logic circuitry.

An illustrative example of a pager that embodies the present invention will now be described with reference to FIG. 1.

As illustrated in the accompanying drawing, the pager, in accordance with the present invention, comprises a paging radio frequency receiver 11; a paging code detector 12; a code-plug memory 14; a shift-register temporary memory 15; a first-in/first-out alert memory 18; a 1-line to 4-line demultiplexer 19; alert indicators 22, 23, 24, 25; a dual 2-input data selector 26; deferred page enable switch 27 and interrogate switch 29, respectively; and a logic circuitry comprised of logic gates 35, 36, 38, 39, 41, 42, 43, all operatively connected as shown to provide necessary paging functions.

The paging code detector 12, the code-plug memory 14 and the shift-register temporary memory 15 are arranged so that they respond to the incoming paging signals detected by the RF (radio frequency) receiver 11 and generate a priority status level signal in response to an emergency signal and a non-priority status level signal in response to a non-emergency signal.

That which determines whether a call is emergency or non-emergency is what is stored in the code-plug memory 14. Memory may have several addresses stored therein: one address, for example, a subscriber number, 876-1234, reserved for emergency call to which the pager must answer immediately, and two other addresses, for example, 876-1235 and 876-1236, reserved for non-emergency calls, which the pager receives for later read-out upon interrogation. The memory 14 can be a removable type, such as a code-plug memory. But it need not be in removable form, it can be an integral part of the hard-wired logic. Removable code-plug memory provides an advantage in that by merely changing the code-plug memory with another one programmed with different numbers, the pager can be structured to receive different subscriber numbers or addresses for the emergency and non-emergency calls.

The shift-register temporary memory 15, the first-in/first-out alert memory 18, the 1-line to 4-line demultiplexer 19 and the dual 2-input data selector 26, as well as the logic circuitry, are all functional circuitries whose design details and operations are the types familiar to one skilled in electronic art. Hence, they will not be described in detail here.

In operation, paging receiver 11 converts radio frequency signals into lower frequency signals such as can be used by the paging code detector 12. The paging code detector 12 processes these signals using information supplied by the code plug memory 14 through the shift-register temporary memory 15, that is, the paging code detector 12 causes information to be transferred from the code plug memory 14 to the shift-register temporary memory 15 whenever this information becomes necessary for its operation. As a consequence of this transfer, the shift-register temporary memory 15 will contain the paging code sought and the corresponding option code. When the paging code detector 12 has detected a code corresponding to the information stored in the shift-register temporary memory 15, it provides a logical 1 to the input of AND gate 38 and AND gate 42. This signal will cause either an alert function to be performed by one of the alert indicators 22–25 or the storage of information in the first-in/first-out alert memory 18 depending on the setting of deferred page enable switch 27 and the presence or lack of a priority page signal from the shift-register temporary memory 15 as further described below.

In the non-deferred paging mode of operation, an alert indicator 22–25 will function for each logical 1 signal level output from the paging code detector 12. This occurs in the following manner. Selection of the non-deferred mode is accomplished by closing deferred page enable switch 27 causing a logical 0 to be applied to the input of NAND gate 36 which is connected to the switch 27 as shown. A logical 0 on either input of NAND gate 36 will cause a logical 1 on its output and those points to which it is connected; namely, the input of INVERTER gate 41 and one of the inputs of AND gate 38. The output of INVERTER gate 41 will, therefore, be a logical 0 as will the output of AND gate 42 to which it is connected.

Under these conditions a logical 1 signal from the paging code detector 12 applied to the inputs of AND gates 38 and 42 will not affect the logical 0 output of AND gate 42 but will cause a logical 1 on the output of AND gate 38, and thereby the input of OR gate 39 to which it is connected. A logical 1 applied on either input of OR gate 39 causes a logical 1 on its output. A logical 1 applied to the data input of the 1-line to 4-line demultiplexer 19, labeled "Alert," causes the alert indicator selected by the output of the dual 2-input data selector 26 to perform an alert function.

The dual 2-input data selector 26 is used to select as input for the 1-line to 4-line demultiplexer 19 either the "Alert Indicator Type" from the shift-register temporary memory 15 or the "Stored Alert Indicator Type" from the first-in/first-out memory 18. In the non-deferred paging mode, interrogate switch 29 would normally be in the "a" position causing a logical 1 at the output of NAND gate 51 and a logical 0 at the output of NAND gate 52. The logical 0 on the output of NAND gate 52 causes the output of AND gate 43, as well as an input of OR gate 39, and the select input of the dual 2-input data selector 26 to be at a logical 0. Under this condition, the dual 2-input data selector will select the "Alert Indicator Type" inputs from the shift-register temporary memory 15 to be passed to the 1-line to 4-line demultiplexer 19.

In the deferred paging mode, non-priority pages are stored in the first-in/first-out memory 18 for recovery at a later time while priority pages cause an immediate alert function to be performed by one of the alert indicators 22–25.

Selection of deferred paging mode is accomplished by opening deferred page enable switch 27 causing a logical 1 to be applied to the input of NAND gate 36 to which it is connected. A priority page differs from a non-priority page in that the "priority" status output from the shift-register temporary memory 15 to the input of INVERTER gate 35 is a logical 1 for a priority page and a logical 0 otherwise. Since this signal is inverted by INVERTER gate 35 before being applied to NAND gate 36, in the deferred paging mode the output of NAND gate 36 will be a logical 1 for priority pages and a logical 0 for non-priority pages.

Should a priority page code be contained in the shift-register temporary memory 15 when the paging code detector 12 detects a code, then the logical 1 output from the paging code detector 12 is applied to the input of AND gate 38 and the logical 1 output of NAND gate 36 is also applied to the input of AND gate 38. This causes AND gate 38 to provide a logical 1 on its output. This, in turn, causes OR gate 39 to apply a logical 1 to the data input of the 1-line to 4-line demultiplexer 19. This, in a manner like that of the non-deferred paging mode described above, causes an alert function to occur. Furthermore, the logical 1 on the output of NAND gate 36 causes a logical 0 on the output of INVERTER gate 41. This logical 0 is applied to one of the inputs of AND gate 42, thus prohibiting the storage of this alert indicator type in the first-in/first-out memory 18.

Should a non-priority page code be contained in the shift-register temporary memory 15 when the paging code detector 12 detects a code, then the logical 0 output of NAND gate 36 which is applied to inputs of INVERTER gate 41 and AND gate 38 causes the output of AND gate 38 to be a logical 0, thus prohibiting immediate alert functions. The output of INVERTER gate 41, however, will be a logical 1 which when applied along with the logical 1 output of the paging code detector 12 to the inputs of AND gate 42 causes a logical 1 on the output of AND gate 42 and on the "store" input of the first-in/first-out memory 18, thus causing the alert indicator type for this page to be stored. The storing of data in the first-in/first-out memory 18 also causes the "not empty" output of the first-in/first-out memory 18 to become a logical 1.

If at any time after an alert indicator type has been stored in the first-in/first-out memory 18, the interrogate switch 29 is moved to the "b" position, then a logical 1 from the output of NAND gate 52 and a logical 1 from the "not empty" output of the first-in/first-out memory 18 will be applied to the inputs of AND gate 43 causing a logical 1 on the output of AND gate 43 which is connected to one of the inputs of OR gate 39 and the "select" input of the dual 2-input data selector 26. A logical 1 on the "select" input of the dual 2-input data selector 26 causes the "Stored Alert Indicator Type" data from the first-in/first-out memory 18 to be passed to the 1-line to 4-line demultiplexer 19, thus selecting the same alert indicator 22–25 as would have occurred had the non-deferred mode of operation been functional at the time the data was stored. The logical 1 input on OR gate 39 causes a logical 1 on the alert input of the 1-line to 4-line data selector 19 leading to the generation of an alert function by the selected alert indicator 22–25. At such time that interrogate switch 29 is returned to the "a" position the output of NAND gate 51 will become a logical 1 while the output of NAND gate 52 will become a logical 0, thus removing the logical 1 condition from the "read" input of the first-in/first-out memory 18 and causing the data previously accessed to be erased.

Figure 2:
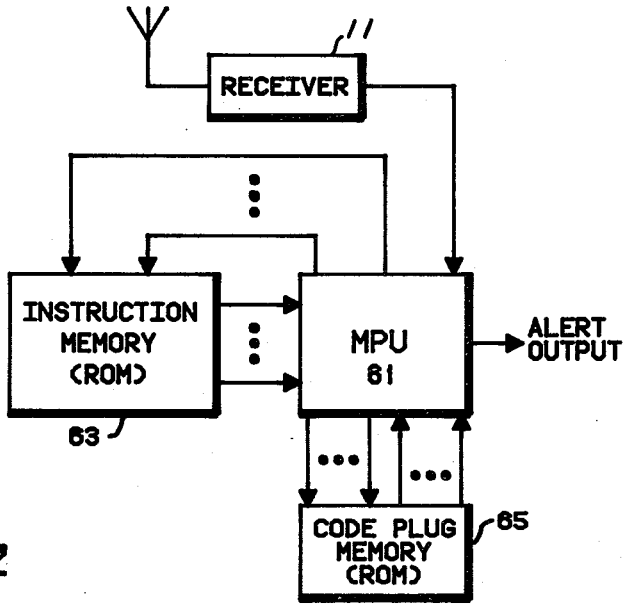
FIG. 2 shows a functional schematic drawing of the present inventive pager embodied in a microprocessor version.

Hereinabove we have described in detail an illustrative embodiment of the present inventive pager primarily in hard logic circuitry with reference to FIG. 1. The inventive pager can be implemented, as illustrated in a functional block diagram form in FIG. 2, using microprocessors which are now widely available worldwide. Obvious advantages gained by the utilization of microprocessors are that the pager can be smaller in size, more versatile, and can include more functions. The microprocessor version is software programmable so that by changing certain of the programs stored in the memory, the functions of the pager can be modified, expanded or changed.

In accordance with the present invention, a microprocessor MPU 61 and associated instruction memory 63 and code-plug memory 65 are operatively programmed and coupled to handle the aforedescribed types of emergency and non-emergency calls. The present invention is implemented by use of the well-known and commonly-available microprocessor. In the implementation, the microprocessor MPU 61 reads instructions from the instruction memory 63, thus performing a sequence of steps resulting in a desired operation. An example of the sequence of operations required to accomplish the desired operation of this invention is shown in a functional flowchart in FIG. 3.

Figure 3:
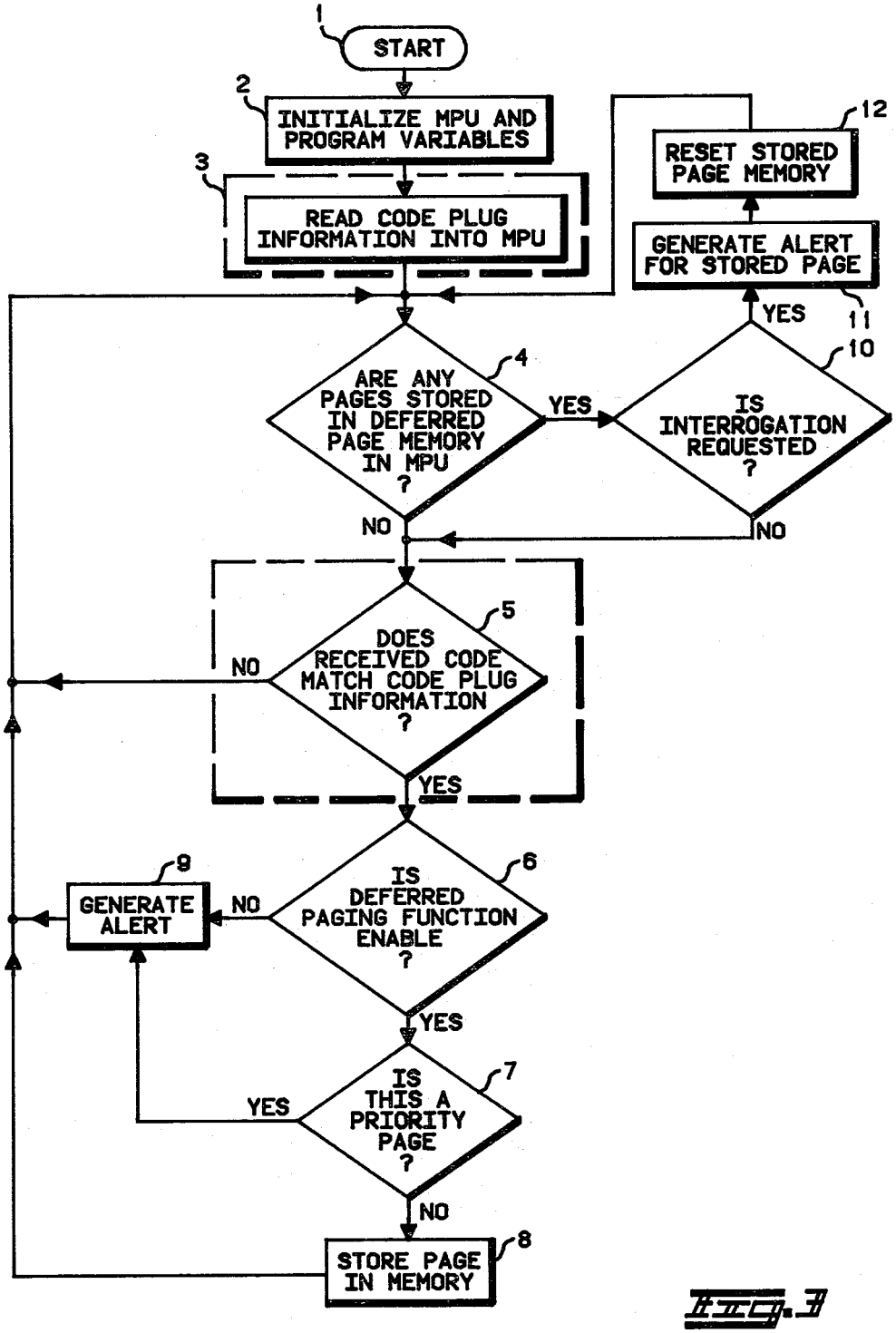
FIG. 3 is a flowchart illustrating the operational sequence that the microprocessor version of the pager in accordance with the present invention is programmed to provide.

FIG. 3 shows a flowchart shown in a conventional form which indicates operational sequence of steps implemented by the microprocessor. Since the operations depicted in the flowchart are shown in a well-known conventional form, detailed step-by-step description of each of the functions and decision blocks is omitted here. However, major functions performed will be briefly described. Blocks 1, 2 and 3 prepare the microprocessor to perform the operation; blocks 4, 10, 11 and 12 perform the interrogate function; and blocks 5, 6, 7, 8 and 9 perform the deferred page storage, the priority page alert, and the normal page alert.

If no pages are stored in the alert memory, the sequence of blocks resulting in a priority page alert is 1, 2, 3, 4, 5, 6, 7, 9, and back to 4. Under the same conditions, the sequence of blocks resulting in the storage of non-priority page is 1, 2, 3, 4, 5, 6, 7, 8, and back to 4. Under the same conditions, the sequence of blocks resulting in a normal page alert is 1, 2, 3, 4, 5, 6, 9, and back to 4. Of course, if the paging code does not match the code-plug code, then the block sequence is 1, 2, 3, 4, 5, and then 4.

At any time that interrogation of non-priority pages stored in memory is desired, the block sequence will start at block 4, and thence, to 10, 11, 12, and back to 4.

Figure 4:
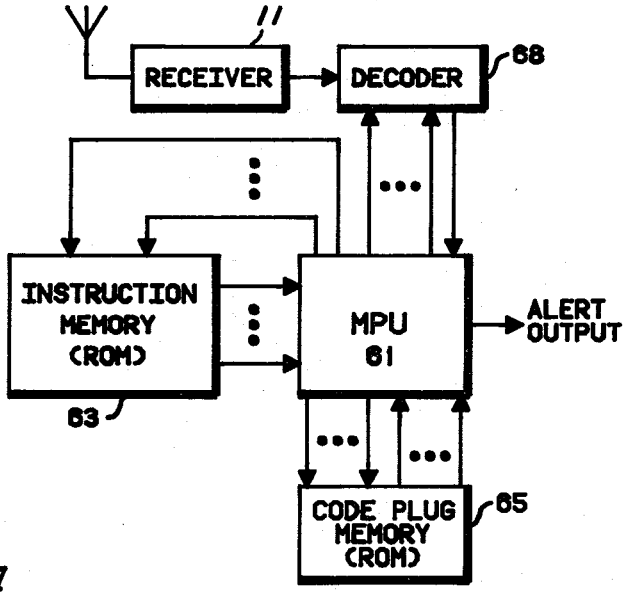
FIG. 4 illustrates yet another functional schematic diagram of the present inventive pager which uses a decoder for applying incoming paging calls to a microprocessor which, in turn, processes the call.
Figure 5:
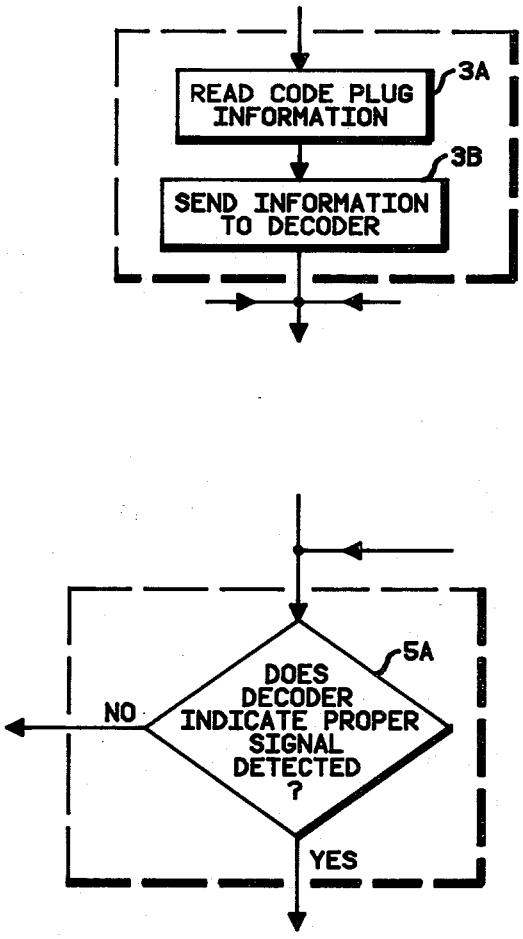
FIG. 5 illustrates modifications to the instruction sequences shown in FIG. 3 involved in the operation of the pager shown in FIG. 4.

Yet another implementation of this invention utilizing a microprocessor is shown in FIG. 4. In this implementation, an external decoder 68 is used to signal the microprocessor that a desired paging code has been received. This combination of decoder and microprocessor is especially convenient when it is desired that the microprocessor also perform many other tasks in addition to those exemplified above. In this way, the task loading of the microprocessor is lightened to handle the other tasks. A flowchart depicting the sequence of operations performed with this modification is the same as shown in FIG. 3, except for steps 3 and 5. Here, steps 3 and 5 are substituted by steps 3A and 3B, and 5A, respectively as shown in FIG. 5, which are self-explanatory.

Hereinabove we have described in detail illustrative embodiments in a generally hard-wired logic form and in a form utilizing a microprocessor. Various changes and modifications will be apparent to those skilled in the art without departing from the spirit and scope of the present invention.

What is claimed is:

1. A pager for receiving similarly-coded incoming calling signals which include user-designated emergency-type calls and non-emergency-type calls, wherein the emergency-type calls require immediate response and non-emergency-type calls can be responded to later at the convenience of the user of the pager, comprising:

means for decoding incoming signals and for distinguishing decoded emergency-type calls from non-emergency type calls;

means for generating an alert signal in response to an emergency-type call; and means for storing an indication of non-emergency-type calls for the generation of a subsequent alert signal.

2. A pager as set forth in claim 1 wherein said means for decoding and distinguishing includes code detector means, a memory for storing data representative of emergency-type calls, and means coupled to the code detector and to the memory for generating a priority status signal when the decoded incoming signal represents an emergency-type call and for generating a non-priority status signal when the decoded incoming signal represents a non-emergency-type call.

3. A pager as set forth in claim 2 wherein said means for generating priority and non-priority status signals includes a temporary storage device for receiving data from the memory, said storage device being coupled to the code detector to permit the code detector to generate an indication that an incoming call corresponds to data in the temporary storage device.

4. A pager as set forth in claim 3 including at least one alert indicator, wherein said temporary storage device is adapted to output alerting data in response to the decoding of an incoming call in addition to generating priority and non-priority status signals, wherein said means for generating an alert signal includes logic circuitry responsive to the non-priority status signal for causing said storing means to store the alerting data and responsive to the priority status signal for initiating the substantially immediate energization of at least one alert indicator in accordance with said alerting data.

5. A pager as set forth in claim 4 including switch means responsive to operator actuation for generating an interrogate signal, wherein said storing means includes a first in-first out memory, wherein said means for generating an alert signal further comprises circuitry which includes a data selector coupled to the first in-first out memory and to the temporary storage device and responsive to the logic circuitry receiving a priority status signal for energizing at least one alert indicator in accordance with the alerting data output by the temporary storage device, and responsive to the interrogate signal for energizing at least one alert indicator in accordance with data stored in the first in-first out memory.

6. A pager for receiving coded incoming calling signals which include emergency-type calls and non-emergency-type calls, wherein the emergency-type calls require immediate response and non-emergency-type calls can be responded to later at the convenience of the operator of the pager, comprising:

means for decoding incoming signals and for distinguishing decoded emergency-type calls from non-emergency-type calls;

means for generating an alert signal;

first manually-operable switch means for placing the pager in a deferred mode wherein only emergency-type calls result in a substantially immediate alert signal, and for placing the pager in a non-deferred mode wherein all incoming calls result in a substantially immediate alert signal, said first switch means being operatively coupled to said decoding means and to said alert signal generating means such that, in the non-deferred mode, said signal generating means develops an alert signal upon the detection of an incoming call by the decoding means and, in the deferred mode, said signal generating means is inhibited from generating an alert signal, except upon the detection of an emergency-type call; and means for storing an indication of non-emergency-type calls while the deferred mode is selected so that subsequent alert signals may be generated.

7. A pager as set forth in claim 6 wherein said first switch means is operatively coupled to said storing means such that, when the pager is in the deferred mode, said storing means stores an indication of received non-emergency-type calls or subsequent readout therefrom.

8. A pager as set forth in claim 7 wherein said storing means comprises a first in-first out memory.

9. A pager as set forth in claim 8 including second manually operable switch means for interrogating the first in-first out memory, and means coupling the output of the latter memory to the alert signal generating means.

10. A pager as set forth in claim 1 wherein said means for decoding, said means for distinguishing, said means for generating an alert signal, and said means for storing include a microprocessor programmed to decode incoming signals, to generate an alerting signal immediately upon receipt of an incoming signal which is detected as an emergency-type call, and to store for subsequent readout, an indication of an incoming signal which is decoded as a non-emergency call.

11. A pager as set forth in claim 10 including a code plug operatively coupled to the microprocessor for storing data representative of emergency-type calls and for outputting said data to the microprocessor.

12. A pager as set forth in claim 10 wherein the microprocessor is adapted to be interrogated for generating an alert signal after a previously decoded incoming signal has been stored as a non-emergency call.

13. A pager as set forth in claim 1 wherein said means or decoding includes a paging code decoder, and wherein said distinguishing means, said alert signal generating means and said storing means included a microprocessor coupled to the decoder, the microprocessor being programmed to generate an alerting signal immediately upon receipt of a decoded emergency-type call, and to store, for subsequent readout, an indication of a decoded incoming signal which corresponds to a non-emergency call.

14. In a pager which receives and decodes similarly-coded incoming calls which may be user-designated as emergency-type calls and non-emergency-type calls, the improvement comprising:

a microprocessor being programmed to:

distinguish decoded emergency-type calls from non-emergency-type calls;

generate an alert signal in response to an emergency-type call; and store an indication of non-emergency-type calls for the generation of a subsequent alert signal.

15. A pager for receiving coded incoming calling signals which include emergency-type calls and non-emergency-type calls, wherein the emergency-type calls require immediate response and non-emergency-type calls can be responded to later at the convenience of the operator of the pager, comprising:

a microprocessor programmed to decode incoming signals, to distinguish emergency-type calls from non-emergency-type calls, and to generate an alert signal in response to a decoded signal, the microprocessor being adapted to operate in a deferred alert mode and in a non-deferred alert mode such that, in the non-deferred alert mode, all decoded incoming signals result in a substantially immediate alert signal and, in the deferred alert mode, emergency-type calls result in the generation of a substantially immediate alert signal whereas an indication of non-emergency-type calls is stored, the microprocessor being adapted to be interrogated for generating an alert signal after a previously decoded incoming signal has been identified as a non-emergency call and an indication thereof stored.

16. In a pager which receives and decodes incoming calls which may be considered as including emergency-type calls and non-emergency-type calls, the improvement comprising:

a microprocessor adapted to operate in a deferred alert mode and in a non-deferred alert mode and being programmed to:

distinguish decoded emergency-type calls from non-emergency-type calls;

generate, when in the non-deferred alert mode, a substantially immediate alert signal in response to an incoming call of either the emergency or non-emergency-type; and when in the deferred alert mode, generate an alert signal in response to an emergency-type call and store an indication of non-emergency-type calls for the generation of a subsequent alert signal.

17. A method of processing incoming paging signals which include emergency-type calls and non-emergency-type calls, comprising:

decoding the incoming paging signals;

distinguishing decoded emergency-type calls from non-emergency-type calls;

selectively operating in a non-deferred alert mode and therein generating a substantially immediate alert signal in response to a paging signal of either the emergency or non-emergency type; and selectively switching to a deferred alert mode and therein generating a substantially immediate alert signal after decoding an emergency-type call and storing an indication of non-emergency-type calls for the generation of a subsequent alert signal.

* * * * *